US010217588B2

(12) United States Patent
Choi

(10) Patent No.: US 10,217,588 B2
(45) Date of Patent: Feb. 26, 2019

(54) ENCLOSED TYPE ELECTROMAGNETIC SWITCH HAVING STATUS INDICATION FUNCTION

(71) Applicant: LSIS CO., LTD., Anyang-si, Gyeonggi-do (KR)

(72) Inventor: Jaehyuk Choi, Anyang-si (KR)

(73) Assignee: LSIS CO., LTD., Anyang-si, Gyeonggi-do (KR)

( * ) Notice: Subject to any disclaimer, the term of this patent is extended or adjusted under 35 U.S.C. 154(b) by 170 days.

(21) Appl. No.: 15/406,695

(22) Filed: Jan. 14, 2017

(65) Prior Publication Data

US 2017/0250044 A1 Aug. 31, 2017

(30) Foreign Application Priority Data

Feb. 25, 2016 (KR) ..... 10-2016-0022682

(51) Int. Cl.

| | |
|---|---|
| ***H01H 50/08*** | (2006.01) |
| ***H01H 73/14*** | (2006.01) |
| ***H01H 71/16*** | (2006.01) |
| ***H01H 83/22*** | (2006.01) |
| ***H01H 37/52*** | (2006.01) |
| ***H01H 50/02*** | (2006.01) |
| ***H01H 89/00*** | (2006.01) |

(Continued)

(52) U.S. Cl.

CPC ..... *H01H 50/08* (2013.01); *H01H 37/52* (2013.01); *H01H 50/02* (2013.01); *H01H 71/16* (2013.01); *H01H 73/14* (2013.01); *H01H 83/223* (2013.01); *H01H 89/00* (2013.01); *H01H 2071/042* (2013.01); *H01H 2071/467* (2013.01); *H01H 2219/036* (2013.01)

(58) Field of Classification Search

CPC ..... H01H 50/08; H01H 37/52; H01H 89/00; H01H 50/02; H01H 83/223; H01H 73/14; H01H 71/16; H01H 2219/036; H01H 2071/467; H01H 2071/042

See application file for complete search history.

(56) References Cited

U.S. PATENT DOCUMENTS 2,059,985 A * 11/1936 Frank ..... H01H 23/025 174/56
2,925,482 A * 2/1960 Bonanno ..... H01H 71/7463 200/314

(Continued)

FOREIGN PATENT DOCUMENTS

CN 101882536 A 11/2010
CN 201655688 U 11/2010

(Continued)

OTHER PUBLICATIONS

Korean Intellectual Property Office Application No. 10-2016-0022682, Search Report dated Apr. 22, 2016, 4 pages.

(Continued)

*Primary Examiner* — Mohamad A Musleh
(74) *Attorney, Agent, or Firm* — K&L Gates LLP

(57) ABSTRACT

The present invention relates to an enclosed type electromagnetic switch having a status indication function, and more particularly, to and enclosed-type electromagnetic switch having a status indication function that can show the electromagnetic switch's status on an enclosure.

2 Claims, 8 Drawing Sheets

(51) Int. Cl.
*H01H 71/04* (2006.01)
*H01H 71/46* (2006.01)

(56) References Cited

U.S. PATENT DOCUMENTS 2,983,804 A * 5/1961 Thomas ..... H01H 71/0207 337/102
3,171,927 A 3/1965 Klein et al.
3,544,749 A * 12/1970 Deangelo ..... H01H 71/46 200/315
3,614,697 A * 10/1971 Dunham ..... H01H 9/10 337/6
3,683,350 A * 8/1972 Shedenheim ..... H01H 73/14 335/10
3,742,403 A * 6/1973 Nicol ..... H01H 71/465 335/13
4,344,100 A * 8/1982 Davidson ..... H02H 3/04 340/644
4,969,063 A * 11/1990 Scott ..... H01H 71/04 200/310
5,373,411 A * 12/1994 Grass ..... H01H 71/04 361/115
5,541,800 A * 7/1996 Misencik ..... H01H 73/14 335/18
5,570,262 A 10/1996 Doerwald
5,699,222 A * 12/1997 Innes ..... H01H 73/14 307/134
5,920,451 A * 7/1999 Fasano ..... H01H 73/14 335/18
2004/0114295 A1* 6/2004 Kim ..... H01H 71/46 361/115
2005/0046526 A1* 3/2005 Lipsey, II ..... H01H 73/14 335/17
2005/0105234 A1* 5/2005 McCoy ..... H01H 71/04 361/103
2012/0162861 A1* 6/2012 Manahan ..... H01H 3/54 361/643

FOREIGN PATENT DOCUMENTS

| | | |
|---|---|---|
| CN | 204029629 | 12/2014 |
| EP | 2015337 | 1/2009 |
| EP | 2546855 | 1/2013 |
| KR | 100482202 | 4/2005 |
| KR | 1020050076933 | 7/2005 |
| KR | 100740220 | 7/2007 |

OTHER PUBLICATIONS

European Patent Office Application Serial No. 16199363.9, Search Report dated Jun. 6, 2017, 7 pages.

* cited by examiner

ENCLOSED TYPE ELECTROMAGNETIC SWITCH HAVING STATUS INDICATION FUNCTION

CROSS-REFERENCE TO RELATED APPLICATION

Pursuant to 35 U.S.C. § 119(a), this application claims the benefit of earlier filing date and right of priority to Korean Application No. 10-2016-0022682, filed on Feb. 25, 2016, the contents of which are all hereby incorporated by reference herein in its entirety.

BACKGROUND OF THE INVENTION

1. Field of the Invention

The present invention relates to an enclosed type electromagnetic switch having a status indication function, and more particularly, to and enclosed-type electromagnetic switch having a status indication function that can show the electromagnetic switch's status on an enclosure.

2. Description of the Conventional Art

In general, a electromagnetic switch is composed of a combination of an electromagnetic conductor and a thermal overload relay. Here, the electromagnetic contactor or direct current relay is a type of electrical circuit switching unit that transfers mechanical motion and current signals by using the principle of an electromagnet, which is installed in a variety of industrial facilities, machines, vehicles, etc. Especially, a relay for electric vehicle is placed in the battery system of electric vehicles such as hybrid vehicles, fuel cell vehicles, golf carts, and forklifts, and serve to switch the main current on or off. Also, the thermal overload relay is a subsidiary device that break a circuit using the thermal expansion characteristics of bimetallic strips embedded in a heater.

Meanwhile, the electromagnetic switch—which switches direct current—is installed between a direct-current generator and an inverter that converts direct-current power to alternating-current power of a commercial frequency and voltage, in environmentally-friendly power generation systems such as solar power generation systems and wind power generation systems, and performs the function of supplying or interrupting the direct-current power to the inverter.

Electromagnetic switches, used for panels for outdoor use, including solar power generation, wind power generation, streetlight control, and night power generation systems, mostly have an enclosed structure because the malfunction and lifetime of devices are strongly affected by exposure to moisture, dust, and impurities. Here, a electromagnetic switch with an enclosure (or case) is referred to as an enclosed type electromagnetic switch.

FIGS. 1 and 2 illustrate the exterior appearance and interior of an enclosed type electromagnetic switch according to the conventional art. The enclosed type electromagnetic switch according to the conventional art has an electromagnetic contactor 3 and a thermal overload relay 4 embedded inside the enclosure 1. The enclosure 1 may be equipped with an on/off button 2 for operating the electromagnetic contactor 3. Also, the electromagnetic contactor 3 may be equipped with auxiliary contacts 5.

FIGS. 3 and 4 illustrate the action of auxiliary contacts of the enclosed type electromagnetic switch according to the conventional art. FIG. 3 shows the electromagnetic switch in the off state, and FIG. 4 shows the electromagnetic switch in the on state.

When a holder 5 is moved downward by the electromagnetic switch 3's interruption operation, a mover 7 moves downward in conjunction with this. Thus, among the auxiliary contacts, NC contacts (contacts b) 8 turn off, and NO contacts (contacts a) 9 turn on. That is, NC movable contacts 8*b* are separated from NC fixed contacts 8*a*, and NO movable contacts 9*a* make contact with NO fixed contacts 9*b*.

However, with the enclosed type electromagnetic switch according to the conventional art, the user is not able to know whether the electromagnetic contactor 3 is normally operating or it is tripped (or stopped) in response to an fault signal detected from a load side, because the electromagnetic contactor 3 is embedded inside the enclosure 1, which gives the user the inconvenience of having to open the enclosure 1 of the product to check.

SUMMARY OF THE INVENTION

The present invention has been made in an effort to solve the above-mentioned problems, and an aspect of the present invention is to provide an enclosed type electromagnetic switch having a status indication function that can show the electromagnetic switch's status on an enclosure.

An enclosed type electromagnetic switch having a status indication function according to an exemplary embodiment of the present invention comprises: an enclosure; an electromagnetic contactor installed inside the enclosure; an auxiliary contact unit attached to one side of the electromagnetic contactor; an overload relay installed inside the enclosure and providing a trip signal to the electromagnetic contactor, the enclosure comprising: a first indicating means that shows that the electromagnetic contactor is in the on state; and a second indicating means that shows that the electromagnetic contactor is in the off state, wherein the first indicating means is connected to contacts a (NO contacts) of the auxiliary contact unit, and the second indicating means is connected to contacts b (NC contacts) of the auxiliary contact unit.

The first and second indicating means operate in a mutually exclusive manner.

The first and second indicating means comprise: first and second conductor parts connected to the NO contacts and the NC contacts, respectively; and first and second indicating parts installed in a way that are exposed through the enclosure.

Mounting holes are formed in part of the enclosure to mounting the first and second indicating means.

The first and second indicating parts are composed of light emitting means or acoustic means.

The enclosed type electromagnetic switch having a status indication function according to an exemplary embodiment of the present invention enables the user to easily identify the status of the electromagnetic contactor with naked eyes without removing the enclosure, since indicating parts for showing the electromagnetic contactor's status are provided inside the enclosure.

This status indication function can be configured easily by using the NC contacts and NO contacts, which are auxiliary contacts.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings:

FIGS. 3 and 4 illustrate the action of auxiliary contacts of the enclosed type electromagnetic switch according to the conventional art, in which FIG. 3 shows the electromagnetic switch in the off state and FIG. 4 shows the electromagnetic switch in the on state;

FIGS. 8 and 9 are views showing the action of auxiliary contacts of an enclosed type electromagnetic switch according to an exemplary embodiment of the present invention, in which FIG. 8 shows that the electromagnetic switch is in the off state and FIG. 9 shows that the electromagnetic switch is in the on state; and FIGS. 10 and 11 are circuit diagrams of first and second indicating means in an enclosed type electromagnetic switch according to an exemplary embodiment of the present invention, in which FIG. 10 shows that the NC contacts are in the on state (the electromagnetic contactor are in the off state), and FIG. 11 shows that the NC contacts are in the on state (the electromagnetic contactor are in the on state).

DETAILED DESCRIPTION OF THE INVENTION

Based on the attached drawings, below are exemplary embodiments of the present invention in detail. The embodiments explained below are merely to enable a person having ordinary skill in the art to which the present invention pertains to readily carry out the invention. Accordingly, the technical idea and scope of the present invention should not be interpreted to be limited.

Figure 1:
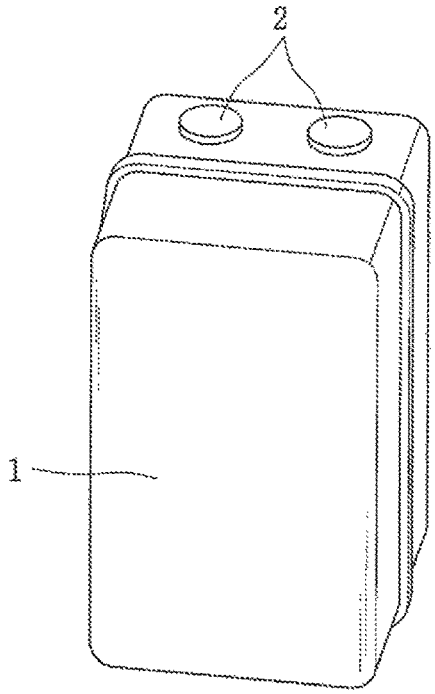
Fig. 1 Prior Art
FIG. 1 is a perspective view of the exterior of an enclosed type electromagnetic switch according to the conventional art.
Figure 2:
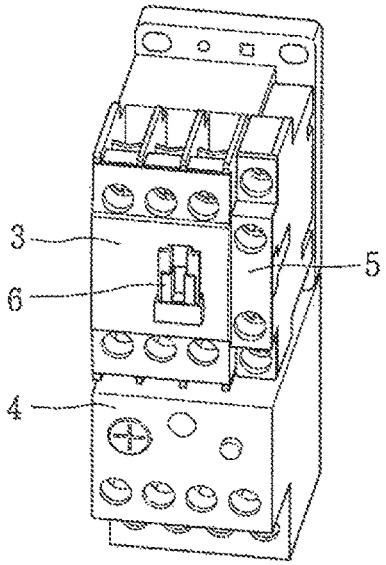
Fig. 2 Prior Art
FIG. 2 is a perspective view of the interior of the enclosed type electromagnetic switch according to the conventional art.
Figure 3:
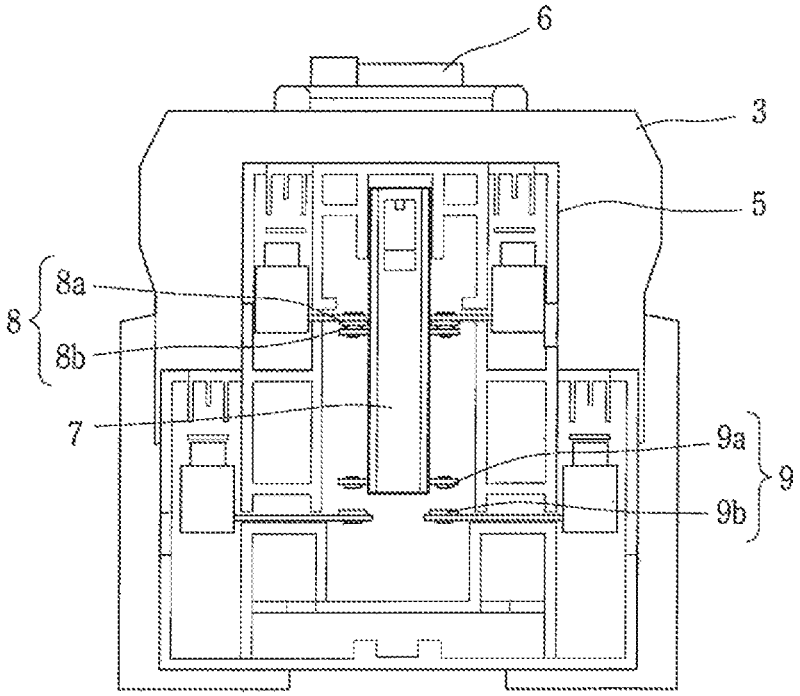
Fig. 3 Prior Art
Figure 4:
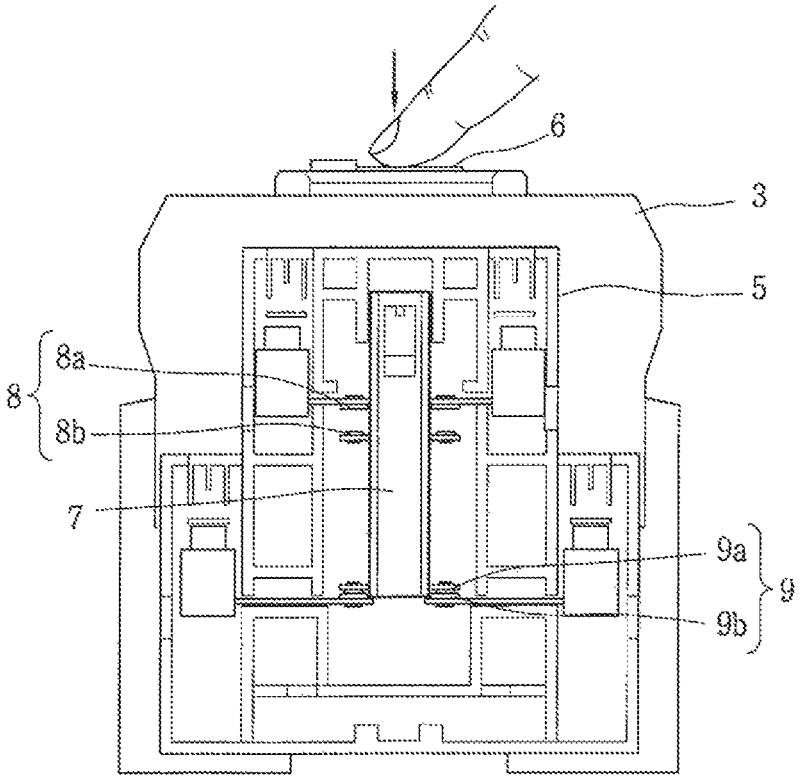
Fig. 4 Prior Art
Figure 5:
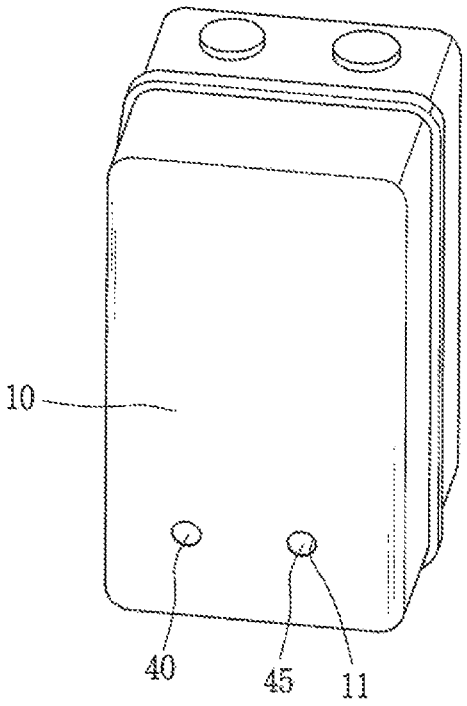
FIG. 5 is a perspective view of the exterior of an enclosed type electromagnetic switch according to an exemplary embodiment of the present invention.
Figure 6:
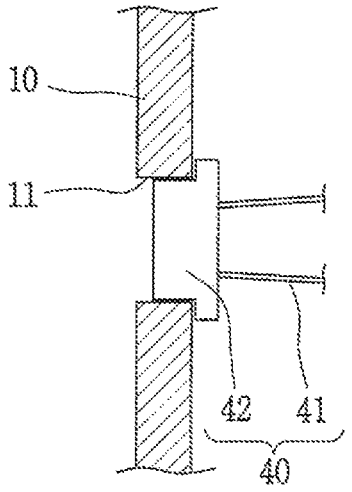
FIG. 6 is a cross-sectional view of the part in FIG. 5 where a first indicating means is installed.
Figure 7:
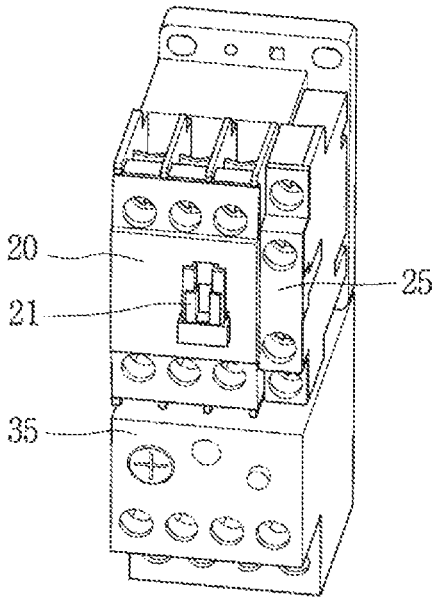
FIG. 7 is a perspective view of the interior of the enclosed type electromagnetic switch according to an exemplary embodiment of the present invention.
Figure 8:
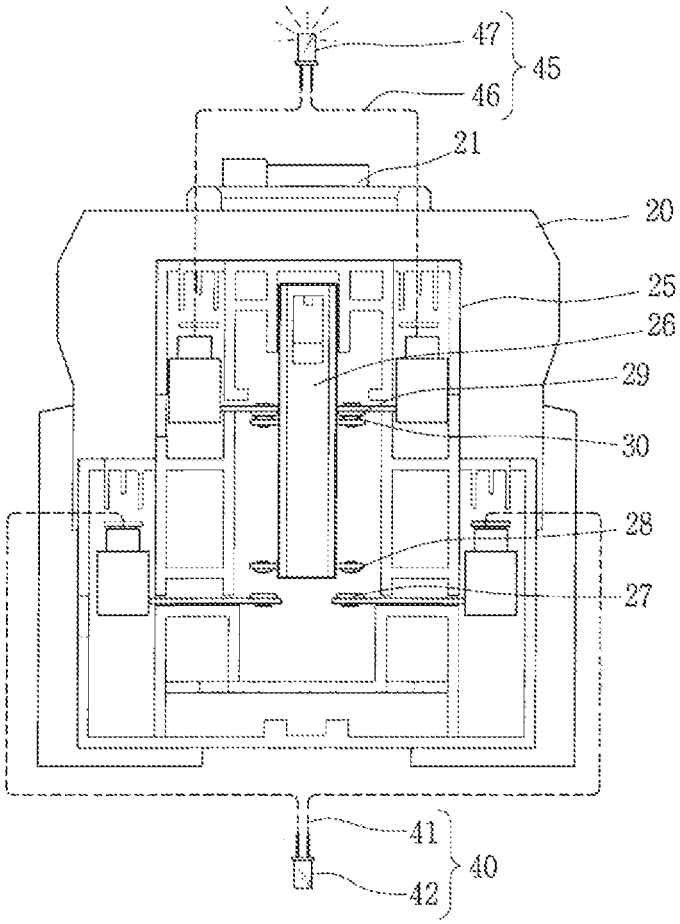
Figure 9:
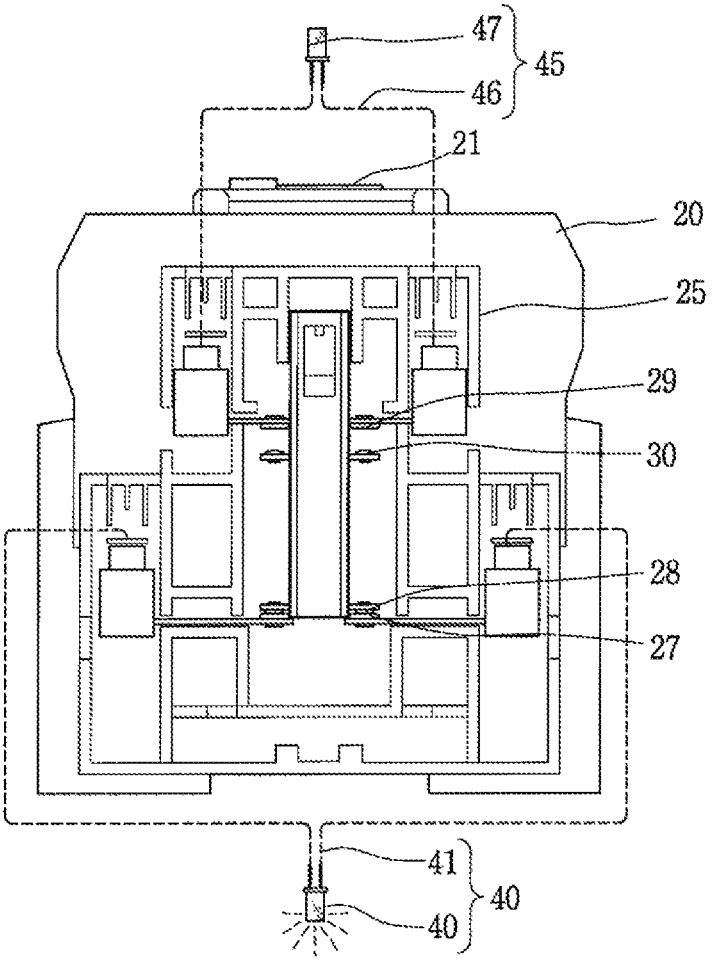

FIG. 5 is a perspective view of the exterior of an enclosed type electromagnetic switch according to an exemplary embodiment of the present invention. FIG. 6 is a cross-sectional view of the part in FIG. 5 where a first indicating means is installed. FIG. 7 is a perspective view of the interior of the enclosed type electromagnetic switch according to an exemplary embodiment of the present invention. FIGS. 8 and 9 are views showing the action of auxiliary contacts of an enclosed type electromagnetic switch according to an exemplary embodiment of the present invention, in which FIG. 8 shows that the electromagnetic switch is in the off state and FIG. 9 shows that the electromagnetic switch is in the on state. An enclosed type electromagnetic switch having a status indication function according to an exemplary embodiment of the present invention will be described in detail with reference to the accompanying drawings.

An enclosed type electromagnetic switch having a status indication function according to an exemplary embodiment of the present invention comprises: an enclosure 10, an electromagnetic contactor 20 installed inside the enclosure 10; an auxiliary contact unit 25 attached to one side of the electromagnetic contactor 20; an overload relay 35 installed inside the enclosure 10 and providing a trip signal to the electromagnetic contactor 20. The enclosure 10 comprises: a first indicating means 40 that shows that the electromagnetic contactor 20 is in the on state; and a second indicating means 45 that shows that the electromagnetic contactor 20 is in the off state or tripped state. The first indicating means 40 is connected to contacts a (NO contacts) of the auxiliary contact unit 25, and the second indicating means 45 is connected to contacts b (NC contacts) of the auxiliary contact unit 25.

The enclosure 10 may be made of steel or synthetic resin. The enclosure 10 may be in the shape of a box of a certain thickness. The enclosure 10 has an enclosed structure so that internal devices operate safely even if the electromagnetic switch according to an exemplary embodiment of the present invention is used for panels for outdoor use, including solar power generation, wind power generation, streetlight control, and night power generation systems and exposed to moisture, dust, and impurities. The enclosure 10 has an electromagnetic contactor 20 and a thermal overload relay 35 embedded in it.

The enclosure 10 has a pair of mounting holes 11 for mounting the first indicating means 40 and the second indicating manes 45.

The electromagnetic contactor 20 is provided to break a circuit when a fault current or over-current flows through the circuit, and has a holder 21. When the holder 21 is pushed down, the electromagnetic contactor goes to the on state, and when the holder 21 is pushed down again and springs back up, the electromagnetic contactor goes to the off state.

The electromagnetic contact 20 has an auxiliary contact unit 25. The auxiliary contact unit 25 has a mover 26 that moves in conjunction with the holder 21 and NO contacts (contacts a) 27 and 28 and NC contacts (contacts b) 29 and 30. The NO contacts 27 and 28 are actuated to the same state as the electromagnetic contactor 20: when the electromagnetic contactor 20 is on, the NO contacts 27 and 28 go into the on state, and when the electromagnetic contactor 20 is off, the NO contacts 27 and 28 go into the off state. The NC contacts 29 and 30 are actuated to the opposite of the electromagnetic contactor 20's state: when the electromagnetic contactor 20 is on, the NC contacts 29 and 30 go into the off state, and when the electromagnetic contactor 20 is off, the NC contacts 29 and 30 go into the on state.

The NC contacts 29 and 30 comprise NC fixed contact 29 that are fixed and installed on part of the auxiliary contact unit 25, and NC movable contacts 30 that are installed on the mover 26 and can touch or be separate from the NC fixed contacts 29. When the electromagnetic contactor 20 is on, that is, the holder 21 is pushed down, as shown in FIG. 9, the mover 26 moves downward, and the NC movable contacts 30 are separated from the NC fixed contacts 29, thereby interrupting the flow of current in the circuit between the NC contacts 29 and 30. By contrary, when the holder 21 returns to the original position, as shown in FIG. 8, the mover 26 moves upward, and the NC movable contacts 30 touch the NC fixed contacts 29, thereby energizing the circuit between the NC contacts 29 and 30.

The NO contacts 27 and 28 comprise NO fixed contact 27 that are fixed and installed on part of the auxiliary contact unit 25, and NO movable contacts 28 that are installed on the mover 26 and can touch or be separate from the NO fixed contacts 27. When the electromagnetic contactor 20 is on, that is, the holder 21 is pushed down, as shown in FIG. 9, the mover 26 moves downward, and the NO movable contacts 28 touch the NO fixed contacts 27, thereby energizing the circuit between the NC contacts 27 and 28. By contrary, when the holder 21 returns to the original position, as shown in FIG. 8, the mover 26 moves upward, and the NO movable contacts 28 are separated from the NO fixed contacts 27, thereby interrupting the flow of current in the circuit between the NO contacts 27 and 28.

The first indicating means 40 is connected to the NO contacts 27 and 28. The first indicating means 40 may comprise a first conductor part 41 connected to the NO contacts 27 and 28 and a first indicating part 42 installed in a way that is exposed through one of the mounting holes 11 of the enclosure 10. The first indicating means 40 shows that the electromagnetic contactor 20 is in the on state.

The second indicating means 45 is connected to the NC contacts 29 and 30. The second indicating means 45 may comprise a second conductor part 46 connected to the NC contacts 29 and 30 and a second indicating part 47 installed in a way that is exposed through the other mounting hole 11 of the enclosure 10. The second indicating means 45 shows that the electromagnetic contactor 20 is in the off state or tripped state.

Here, the first indicating means 40 and the second indicating means 45 operate in a mutually exclusive manner. That is, when the first indicating means 40 is in the on state, the second indicating means 45 is in the off state, and when the first indicating means 40 is in the off state, the second indicating means 45 is in the on state.

The overload relay 35 is installed on one side of the electromagnetic contactor 20. The overload relay 35 provides a trip signal to the electromagnetic contactor 20. Here, the thermal overload relay 35 may be a thermal overload relay, for example. The thermal overload relay 35 may be configured to operate using the thermal expansion properties of bimetal.

Figure 10:
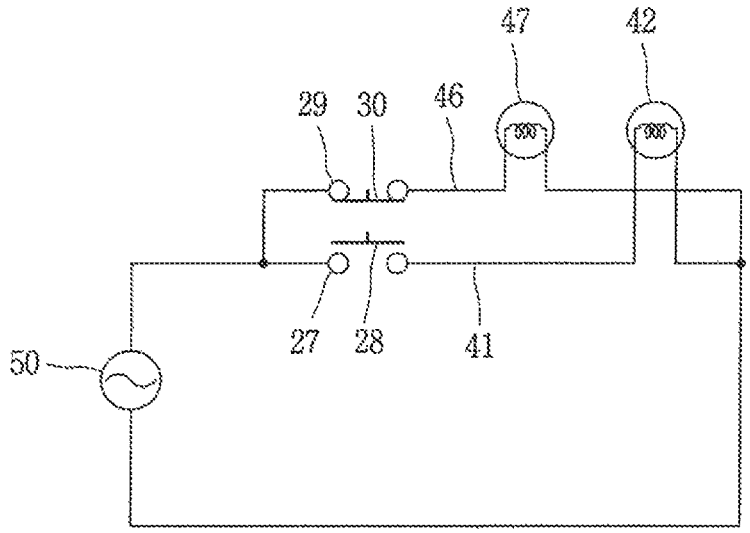
Figure 11:
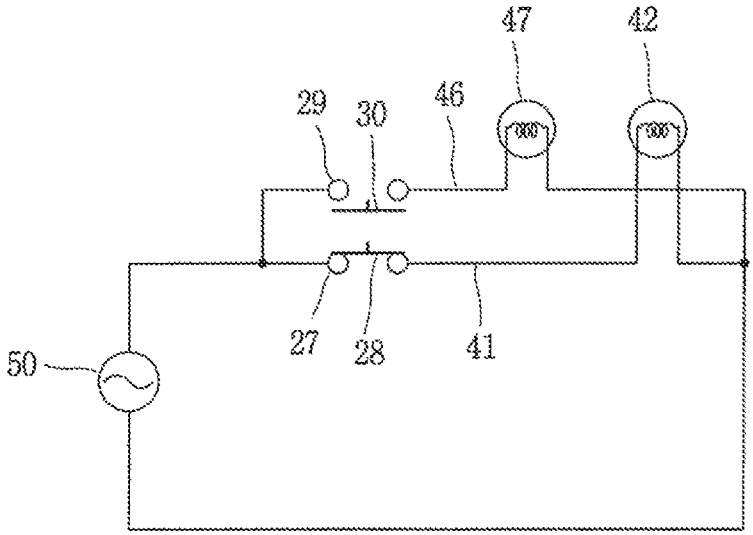

FIGS. 10 and 11 show the circuit operation status of the first indication means 40 and second indication means 45. FIG. 10 shows that the electromagnetic contactor 20 is in the off state, meaning that the NC contacts 29 and 30 are in the on state and the NO contacts 27 and 28 are in the off state. FIG. 11 shows that the electromagnetic contactor 20 is in the on state, meaning that the NC contacts 29 and 30 are in the off state and the NO contacts 27 and 28 are in the on state.

Here, a power supply 50 may be the power supply of the electromagnetic contactor 20 or a separate external power supply.

A first indicating part 42 and a second indicating part 47 each may be composed of a light emitting mean such as a lamp. Accordingly, when the electromagnetic contactor 20 is in the on state, the first indicating part 42 emits light, and when the electromagnetic contactor 20 is in the off state, the second indicating part 47 emits light, so that the user is able to easily identify the status of the electromagnetic contactor 20 with naked eyes without removing the enclosure 10.

Moreover, the first indicating part 42 and the second indicating part 47 each may be composed of an acoustic means such as a boozer. In this case, the first indicating part 42 and the second indicating part 47 may be configured to make different sounds. That is, the first indicating part 42 and the second indicating part 47 can be distinguished because they make sounds in different pitches, amplitudes, or tones.

The enclosed type electromagnetic switch having a status indication function according to an exemplary embodiment of the present invention enables the user to easily identify the status of the electromagnetic contactor with naked eyes without removing the enclosure, since indicating parts for showing the electromagnetic contactor's status are provided inside the enclosure.

This status indication function can be configured easily by using the NC contacts and NO contacts, which are auxiliary contacts.

The above description is merely intended to illustratively describe the technical spirit of the present invention, and those skilled in the art to which the present invention pertains, various changes and modifications may be possible without departing from the essential features of the present invention. Therefore, the embodiments disclosed in the present invention are not intended to limit the technical spirit of the present invention and are merely intended to describe the present invention, and the technical spirit of the present invention is not limited by those embodiments of the present invention. The scope of protection of the present invention should be interpreted by the accompanying claims, and all technical spirits in equivalents thereof should be interpreted as being included in the scope of the present invention.

What is claimed is:

1. An enclosed type electromagnetic switch having a status indication function, the enclosed type electromagnetic switch comprising:

an enclosure having an enclosed structure; and an electromagnetic switch, wherein the enclosure, which is separate from and independent of the electromagnetic switch, encloses the entire electromagnetic switch to protect the electromagnetic switch from moisture, dust, or impurities, wherein the electromagnetic switch comprises:

an electromagnetic contactor installed inside the enclosure;

an auxiliary contact unit attached to one side of the electromagnetic contactor; and an overload relay installed inside the enclosure and providing a trip signal to the electromagnetic contactor, wherein the enclosure comprises:

a first indicating means that is installed on the enclosure and connected to contacts a (NO contacts) of the auxiliary contact unit to show that the electromagnetic contactor is in the on state; and a second indicating means that is installed on the enclosure and connected to contacts b (NC contacts) of the auxiliary contact unit to show that the electromagnetic contactor is in the off state, and wherein the first indicating means and the second indicating means operate in a mutually exclusive manner to each other, wherein the first and second indicating means include first and second conductor parts connected to the contacts a and the contacts b, respectively, and first and second indicating parts installed in a way that are exposed on the enclosure, and wherein mounting holes are formed in part of the enclosure to mount the first and second indicating means.

2. The enclosed type electromagnetic switch of claim 1, wherein the first and second indicating parts are composed of light emitting means or acoustic means.

* * * * *